United States Patent [19]

Edwards et al.

[11] Patent Number: 4,517,426

[45] Date of Patent: May 14, 1985

[54] ELECTRICAL BUSSING FOR A SWITCH ARM CONNECTOR BLOCK

[75] Inventors: James D. Edwards, Brentwood; Charles Malone, Franklin, both of Tenn.

[73] Assignee: The Scott & Fetzer Company, Fairview, Tenn.

[21] Appl. No.: 584,782

[22] Filed: Feb. 29, 1984

[51] Int. Cl.[3] ..... H01H 43/10; H01H 1/26

[52] U.S. Cl. ..... 200/38 A; 200/283; 200/38 C

[58] Field of Search ..... 200/283, 38 R, 38 A, 200/38 B, 38 BA, 38 C, 38 CA, 39 R, 39 A; 361/331, 332, 410, 416, 421, 425, 426, 428, 429; 339/18, 19, 198

[56] References Cited

U.S. PATENT DOCUMENTS 3,390,243 6/1968 Obermann ..... 200/38 C X 3,431,372 3/1969 Obermann ..... 200/38 A 3,771,102 11/1973 Murray et al. ..... 339/198 N X

*Primary Examiner*—J. R. Scott

*Attorney, Agent, or Firm*—Pearne, Gordon, Sessions, McCoy, Granger & Tilberry

[57] ABSTRACT

A switch arm connector block for mounting a plurality of spring switchblades in a predetermined array for sequential cooperation with a timer cam and for providing a quick-disconnect connector for electrically connecting the blades to a wiring harness is disclosed. The connector block is formed by a plurality of insulating wafers which encapsulate a plurality of flat, parallel switchblades. The faces of the wafers are spaced from each other by projecting curbs around the perimeters of the wafers and window openings are provided in the wafers so that internal bussing may be provided in the block. End bussing is provided and the end bussing strips are covered by a protective cap having insulating fences for protecting the bussing strips.

20 Claims, 3 Drawing Figures

ELECTRICAL BUSSING FOR A SWITCH ARM CONNECTOR BLOCK

BACKGROUND OF THE INVENTION

This invention relates to electrical connectors and, more particularly, to a switch arm connector block for mounting a plurality of spring switchblades in a predetermined array for sequential cooperation with an electrical appliance timer cam.

Electrical appliance timers employ rotary cam elements which actuate cycle control switches having movable or active blades which ride on the cam elements. The cam elements are arranged on the surface of a rotary drum cam of the type set forth in U.S. Pat. Nos. 3,390,243 and 3,431,372, or a rotary disc cam of the type set forth in U.S. Pat. No. 2,703,347. Each active blade extends as a cantilever from a terminal block and, upon cam-actuated movement, makes or breaks contact with one or more associated fixed blades which also extend as cantilevers from the terminal block.

Appliance manufacturers require increasingly more complex cycles in appliances, such as clothes washers and dryers, thus necessitating increasingly more complex switching functions in the timer, which is alloted a finite amount of space in the appliance by the design engineer. Timer manufacturers have been faced with the problem of compressing a large number of switch arms into a relatively small space for operation by the rotary cam elements, and, because of the increased number of cycles of the appliance, providing compact and simple bussing arrangements between the various switch elements without complicated wiring schemes or the provision of additional switch elements or cams.

Prior art practices, therefore, typically provide a connector block having compact bussing associated with a terminal connector block. Examples of such arrangements may be found in U.S. Pat. Nos. 3,431,372; 3,390,243; and 3,771,102. These prior art arrangements include a plurality of active and fixed blades which are molded into plastic insulating wafers so that the blades are coplanar in the wafer and extend from one end of the wafer as cantilevered switchblades and extend from the other end of the wafer as connecting blades for cooperation with the disconnect-connect portion of a wiring harness. A series of wafers are stacked together to form a completed terminal switch block, with the blades arranged in coplanar ranks and their axes in coplanar files.

In U.S. Pat. Nos. 3,390,243 and 3,431,372, there is disclosed a bussing arrangement which enables bussing between selected blades in different vertical alignment, or in the same alignment, by stabbing through window openings in the wafers to engage projecting tabs in some of the openings. While this arrangement performs satisfactorily, connecting portions of the bussing strips lie in an exposed condition over the assembled connector block. Moreover, the electrical connection is a frictional edge contact connection, which is not an ideal electrical connection. Still further, since the window openings through the wafers are made during an injection molding operation, plastic flash may cover portions of the switch body portions which are intended to be electrically connected by the busses.

In U.S. Pat. No. 3,771,102, there is disclosed an end bussing arrangement wherein buss bars are provided in channels molded into a connector cap for the terminal block. The buss bars are loosely fitted in the channels and, again, frictional contact is relied upon for the electrical connection. If the cap is removed from the terminal block, there exists the possibility of the bussing bar's falling out of its proper channel.

SUMMARY OF THE INVENTION

This invention provides a switch arm connector block for mounting a plurality of spring switchblades in a predetermined array for sequential cooperation with a timer cam and for providing a quick-disconnect connector for electrically connecting the blades to a wiring harness of an electrical appliance. The connector block according to this invention includes internal bussing within the connector block for electrically connecting switch arms which are operated by a rotary cam, such as a disc cam. The connector block according to this invention comprises a plurality of insulating wafers and each wafer encapsulates a plurality of parallel switchblades which are molded therein so that the switchblades are parallel to each other and form a single planar rank. Each wafer is provided with a raised rim and engages a neighboring wafer so that an internal space is provided between each wafer. Window openings are molded into the face of each wafer so that body portions of each switchblade are exposed and are available for electrical bussing within an assembled terminal block. The windows and the internal space between adjacent wafers comprise tunnel means within the terminal block to provide for internal bussing. Bussing strips are spot-welded to preselected, exposed switchblade body portions to comprise the internal bussing. The wafers are assembled in a stacked array so that the switchblades which project as cantilevers from one end of the terminal block have axes which are aligned in parallel ranks.

End bussing is provided in order to connect selected switch arms in selected ranks to other switch arms in other ranks. To this end, bussing elements are provided which follow tortuous paths from cantilevered quick-disconnect elements protruding from the end of the terminal block to other protruding quick-disconnect elements in adjacent or remote ranks, avoiding any intervening, non-connected connectors. Insulators project from the end face of a protective cover to isolate the bussing elements from any bypassed, non-electrically connected connector elements. The bussing element is spot-welded to the elements to be electrically connected for an optimum electrical connection.

DETAILED DESCRIPTION OF THE DRAWINGS

Figure 1:
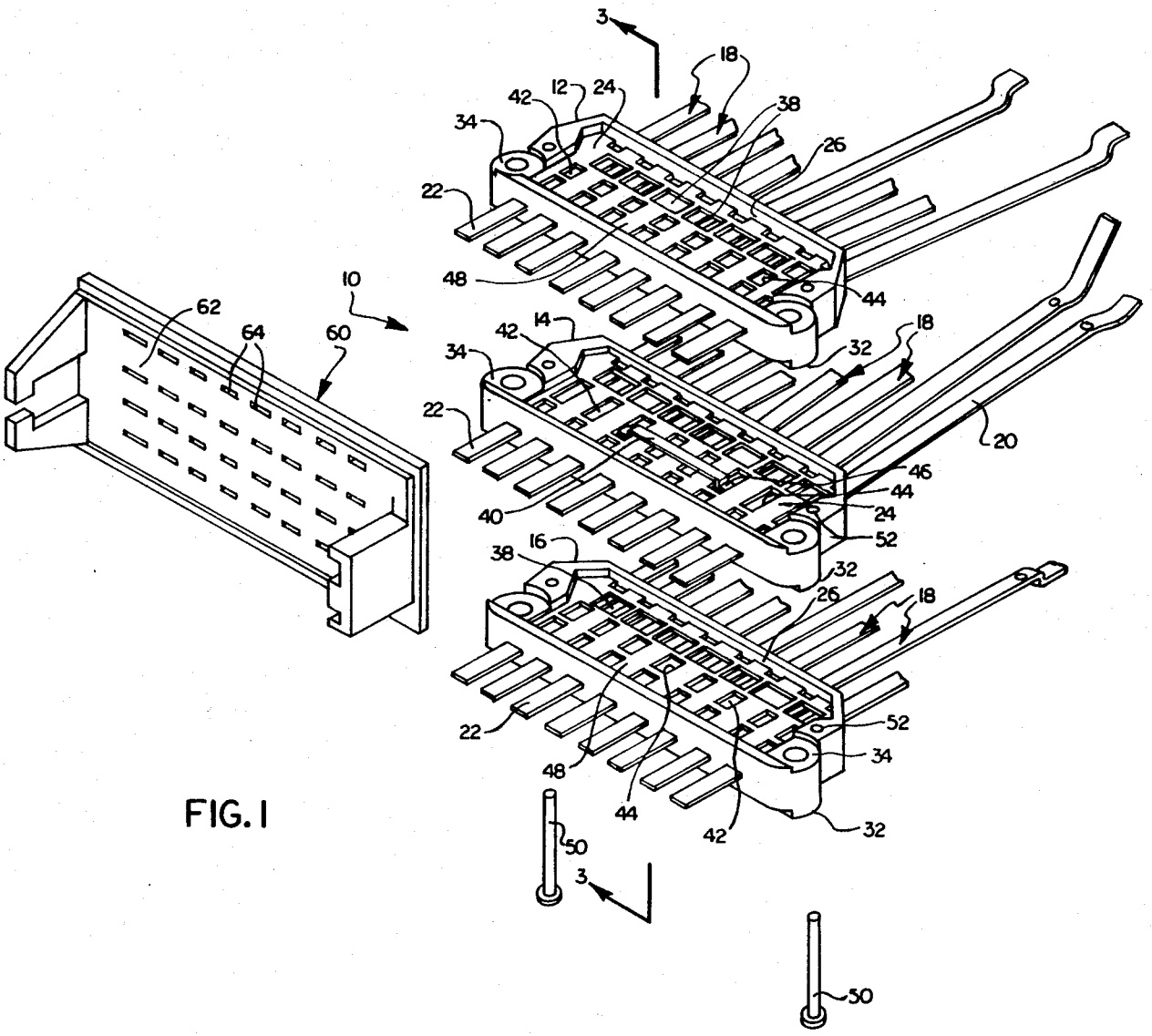
FIG. 1 is an exploded perspective view of a plurality of wafers and a protective cover which are assembled to form a connector block according to this invention.

Referring now to FIG. 1, there is illustrated a switch arm connector block 10 which comprises a plurality of wafers 12, 14, and 16. Each wafer 12, 14, and 16 is injection molded from a suitable thermoplastic material, and carries a plurality of switch elements 18. The switch elements 18 are molded into the wafers 12, 14, and 16 and have switch ends 20 projecting as cantilevers from one end face of the wafers 12, 14, and 16 and quick-disconnect blades 22 projecting as cantilevers from the opposite face of the wafer.

Figure 3:
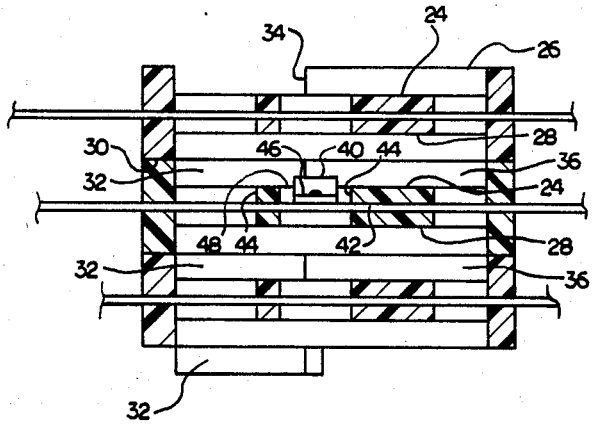
FIG. 3 is a cross-sectional view of the wafers in an assembled condition, the plane of the section being indicated by the line 3—3 in FIG. 1.

Each wafer is identical and has a recessed top face 24 surrounded by a projecting curb 26. Similarly, each wafer has a recessed bottom face 28 (FIG. 3) surrounded by a projecting curb 30. Annular bosses 32 project from the bottom face 28 and are received in an annular recess 34 on the upper face of each wafer partially defined by the curb 26. Thus, when the wafers are stacked in a face-to-face array, as is illustrated in FIG. 3, a space 36 is provided between a bottom face 28 and a top face 24 of the wafers 12, 14, and 16.

The switch elements 18 are formed by conventional progressive stamping techniques, and during the stamping operation, webs connect adjacent switch elements. At the final stamping operation, a web is cut to provide a desired number of connected switch elements 18 for use in the injection molding operation. An example of such an assembly may be seen in U.S. Pat. No. 3,431,372. Their injection mold is defined so that web apertures 38 are provided in the top and bottom faces 24 and 28, and the connecting webs may be severed after the molding operation by driving a cutting tool through the apertures 38. If desired, however, certain of the webs may be left intact to provide electrical connection between adjacent switch elements 18.

Each wafer 12, 14, and 16 carries the switch elements 18 so that the switch elements are coplanar and form a rank. Selected switch elements of the rank are electrically connected by internal bussing strips 40. Body portions 42 of the switch elements 18 are exposed by providing a series of windows 44 in at least the top face 24 of each wafer. To accommodate a plurality of connections among the switch elements 18 in a rank, a plurality of windows 44 may be provided for each switch element 18. The bussing elements 40 are thin conductive ribbons having depending faces 46 which are spot-welded to selected body portions 42 to provide electrical connections among preselected switch elements. Wall portions 48 between adjacent windows 44 serve to insulate the bussing strips 40 from bridged body portions 42.

After the wafers are bussed in a desired manner, the wafers 12, 14, and 16 are stacked together so that the bosses 32 register with the recesses 34 and rivets 50 are driven through apertures 52 in the wafers to hold the wafers in a clamped array.

The clamped assembly which forms the connector block 10 includes a plurality of ranks of switch elements 18, with the number of ranks being determined by the number of wafers. In the assembled condition, the switch elements 18 have axes which are coplanar with the axes of the switch elements 18 in adjacent ranks so that files of switch elements are formed, with the number of files determined by the number of switch elements in a wafer.

End bussing of the connector block is accomplished by end bussing strips 54. The bussing strips 54 are conductive ribbons and have end portions 56 which are spot-welded to selected projecting quick-disconnect blades 22 in the same file or in an adjacent or remote file formed by the blades 22. Thus, a body portion 58 of a bussing strip 54 may take a circuitous route between the electrically connected blades 22 to avoid contact with intervening switchblades 22.

Figure 2:
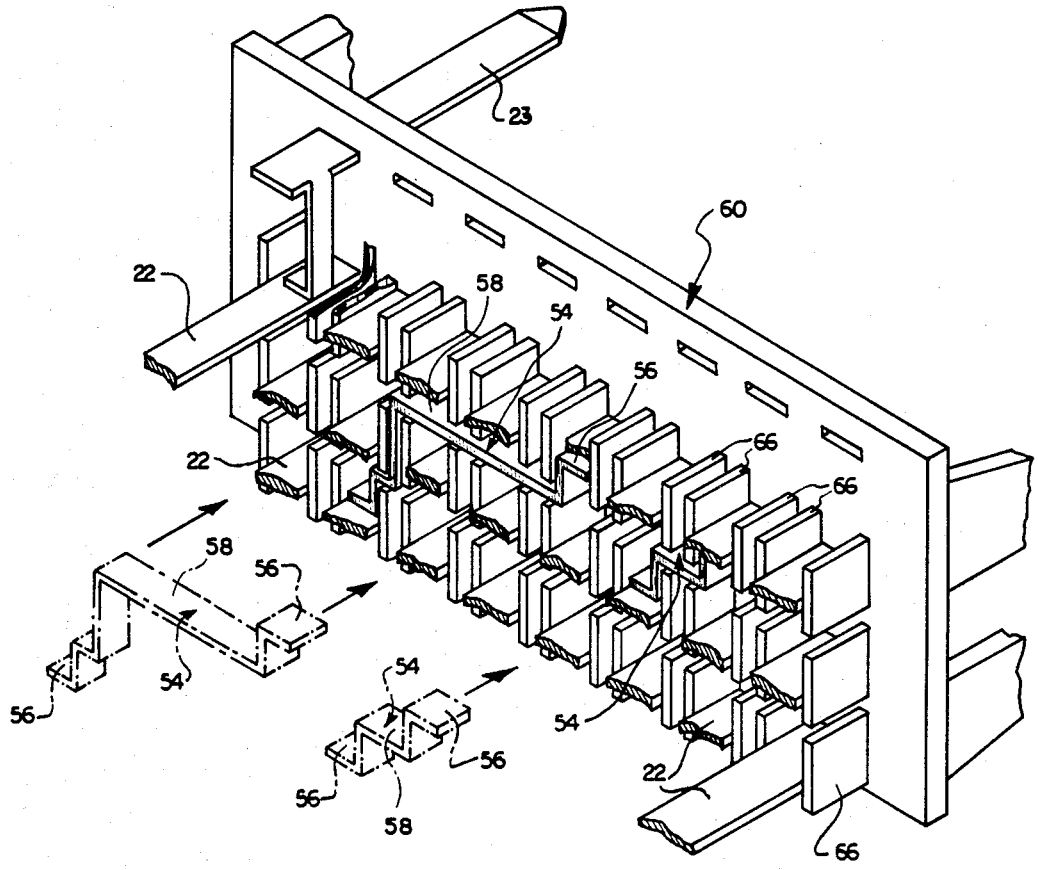
FIG. 2 is a perspective view of the protective cover and cooperating connecting blade ends of the switchblades and end bussing elements.

To further ensure that the body portions 58 of the end bussing strips will not contact the intervening blades 22, and to enclose the end bussing strips 54, a connector end protective cover 60 is provided. The cover 60 has a flat face 62 provided with a plurality of slotted apertures 64 which conform to the position of the projecting quick-disconnect blades 22. As may be seen in FIG. 2, one face of the cover 60 is provided with integral projecting insulating fences 66, which project toward the connector block 10 and which engage an end face of the block formed by the stacked array of wafers. When the blades 22 are received in the apertures 64, the fences 66 engage each lateral edge of a blade 22 in a rank. The fences 66 embracing the blades 22 in a rank are spaced from other fences 66 engaging the blades in an adjacent rank. The resulting arrangement provides insulated paths or channels among the blades for end bussing by means of the end bussing strips 54. It should be appreciated that the fences 66 need only be provided adjacent those quick-disconnect blades 22 which need to be isolated from an end bussing strip 54. Thus, with a predetermined bussing pattern established, end covers 60 may be fabricated to provide only the necessary fences 66.

Additional auxiliary blades 23 may be provided which are electrically connected to the wafer-mounted quick-disconnect blades 22. As may be seen in FIG. 2, an auxiliary blade 23 may be spot-welded to one of the quick-disconnect blades 22.

Although the preferred embodiment of this invention has been shown and described, it should be understood that various modifications and rearrangements of the parts may be resorted to without departing from the scope of the invention as disclosed and claimed herein.

What is claimed is:

1. A switch arm connector block for mounting a plurality of spring switchblades in a predetermined array for sequential cooperation with a timer cam and for providing a quick disconnect connector for electrically connecting the blades to a wiring harness comprising insulating block means, a plurality of flat, parallel switchblades passing through and having body portions encapsulated by said block means, said switchblades defining a first series of parallel planes and having longitudinal axes defining a second series of parallel planes transverse to said first series, said blades extending transversely as cantilevers from an end face of said insulating block means, tunnel means in said block for providing passageways along said first series of planes between and among the encapsulated switchblade body portion defining each of said first series of parallel planes, bussing means within said passageways electrically connecting at least two switchblades in at least one of said first series of parallel planes, means defining channels at said end face of said block means, and bussing means in said channels providing an electrical connection between a switchblade in one of said first series of parallel planes and a switchblade in another one of said first series of parallel planes.

2. A switch arm connector block according to claim 1, wherein each said bussing means is a conductive ribbon having faces spot welded to selected body portions to provide said electrical connection.

3. A switch arm connector block according to claim 2, wherein said ribbon bridges any body portions between electrically connected body portions to provide a space between the ribbon and non-connected body portions.

4. A switch arm connector block according to claim 3, wherein insulation means is provided in said space.

5. A switch arm connector block according to claim 1, wherein said block comprises a series of wafers clamped and retained in a stacked array and wherein said tunnel means is provided by means for spacing opposed wafer faces from each other and further comprises window openings in the face of each wafer to expose selected body portions of the switch arms.

6. A switch arm connector block according to claim 5, wherein each of said bussing means is a conductive ribbon having faces spot-welded to selected body portions to provide said electrical connection.

7. A switch arm connector block according to claim 6, wherein said ribbon bridges any body portions between electrically connected body portions to provide a space between the ribbon and non-connected body portions.

8. A switch arm connector block according to claim 7, wherein insulation means is provided in said space.

9. A switch arm connector block according to claim 8, wherein said windows are separated by wall portions and wherein said wall portions comprise said insulation means.

10. A switch arm connector block for mounting a plurality of spring switchblades in a predetermined array for sequential cooperation with a timer cam and for providing a quick disconnect connector for electrically connecting the blades to a wiring harness comprising insulating block means, a plurality of flat, parallel switchblades passing through and having body portions encapsulated by said block means, said switchblades defining a first series of parallel planes and having longitudinal axes defining a second series of parallel planes transverse to said first series, tunnel means in said block for providing passageways along said first series of planes between and among the encapsulated switchblade body portions defining each of said first series of parallel planes, bussing means within said passageways electrically connecting at least two switchblades.

11. A switch arm connector block according to claim 10, wherein said ribbon bridges any body portions between electrically connected body portions to provide a space between the ribbon and non-connected body portions.

12. A switch arm connector block according to claim 11, wherein insulation means is provided in said space.

13. A switch arm connector block according to claim 10, wherein said block comprises a series of wafers clamped and retained in a stacked array and wherein said tunnel means is provided by means for spacing opposed wafer faces from each other and further comprises window openings in the face of each wafer to expose selected body portions of the switch arms.

14. A switch arm connector block according to claim 13, wherein each of said bussing means is a conductive ribbon having faces spot-welded to selected body portions to provide said electrical connection.

15. A switch arm connector block according to claim 14, wherein said ribbon bridges any body portions between electrically connected body portions to provide a space between the ribbon and non-connected body portions.

16. A switch arm connector block according to claim 15, wherein insulation means is provided in said space.

17. A switch arm connector block according to claim 16, wherein said windows are separated by wall portions and wherein said wall portions comprise said insulation means.

18. A switch arm connector block for mounting a plurality of spring switchblades in a predetermined array for sequential cooperation with a timer cam and for providing a quick-disconnect connector for electrically connecting the blades to a wiring harness comprising a plurality of insulating wafers, each wafer having a plurality of parallel switchblades having body portions encapsulated within a single planar rank, means for clamping and retaining said wafers in a stacked array so that each blade in a rank comprises a member of a planar file, a plurality of windows in each wafer exposing encapsulated body portions of each switchblade in said rank, bussing means between at least one pair of stacked wafers electrically connecting an exposed body portion of a switchblade to at least one other body portion of another switchblade in a planar rank.

19. A switch arm connector block for mounting a plurality of spring switchblades in a predetermined array for sequential cooperation with a timer cam and for providing a quick-disconnect connector for electrically connecting the blades to a wiring harness comprising a plurality of insulating wafers, each wafer having a plurality of parallel switchblades having body portions encapsulated within a single planar rank, means for clamping and retaining said wafers in a stacked array so that each blade in a rank comprises a member of a planar file, a plurality of windows in each wafer exposing encapsulated body portions of each switchblade in said rank, bussing means between at least one pair of stacked wafers electrically connecting an exposed body portion of a switchblade to at least one other body portion of another switchblade in a planar rank, said stacked array forming an end face from which said blades project, means defining channels at said end face, and bussing means in said channels providing an electrical connection between a switchblade in one of said ranks and a switchblade in another one of said ranks.

20. A switch arm connector block according to claim 19, wherein said channel defining means comprises an end cap having a plurality of slots adapted to receive switchblades projecting from said end face and a plurality of insulating fingers projecting from said cap.

* * * * *